US006488600B1

(12) United States Patent
Gordon

(10) Patent No.: US 6,488,600 B1
(45) Date of Patent: Dec. 3, 2002

(54) SPORTS FLOOR STRUCTURE

(75) Inventor: Mason Gordon, Sherman Oaks, CA (US)

(73) Assignee: Time Warner Entertainment Co. L.P., New York, NY (US)

( * ) Notice: Subject to any disclaimer, the term of this patent is extended or adjusted under 35 U.S.C. 154(b) by 0 days.

(21) Appl. No.: 09/619,136

(22) Filed: Jul. 18, 2000

(51) Int. Cl.[7] ..... A63B 61/00; A63B 67/18; A63C 19/06

(52) U.S. Cl. ..... 473/490; 473/415

(58) Field of Search ..... 473/490, 477, 473/415; 267/116

(56) References Cited

U.S. PATENT DOCUMENTS 3,831,941 A * 8/1974 Pease ..... 267/116
5,524,882 A * 6/1996 Wagner ..... 473/477

FOREIGN PATENT DOCUMENTS

DK 0 846 481 A2 2/1996
FR 2 561 698 A1 3/1984

OTHER PUBLICATIONS

Funfacts—http://members.aol.com/msdaizy/sports3/fun7.html–p. 1, Jan. 1, 1995.*
Fansonly—http://www.fansonly.com/channels/news/sports/c–gym/uwire/012201aaf.htlm–p. 1–3, 2001.*
Anchorage–YMCA—http://www.ymca.ak.org/ymca5.html–p. 1, 1996.*
UCBS Office of student life—http://www.sa.ucsb.edu/osl/CampusScheduling.SchedulingFacilities.asp–pp. 1–4, 1999.*
Flooring article—http://www.prm.nau.edu/prm423/Flooring%20article.htm–pp. 1–4, 1998.*
US 2002/0010042 A1(Gordon, Jan. 24, 2002).*

* cited by examiner

*Primary Examiner*—Paul T. Sewell
*Assistant Examiner*—M. Chambers
(74) *Attorney, Agent, or Firm*—O'Melveny & Myers LLP

(57) ABSTRACT

A court for accommodating players in play of a game that employs a ball comprising a floor including a playing surface having ends, goals each supported proximate one of the ends, markings on the playing surface that define fields that govern the play of the game, a spring-loaded bias provided by the floor at each of the fields and padded fields proximate the goals for absorbing player falls.

11 Claims, 2 Drawing Sheets

SPORTS FLOOR STRUCTURE

FIELD OF THE INVENTION

This invention relates to floor structures for accommodating players in play of a game.

BACKGROUND OF THE INVENTION

Main stream sports like basketball, football, hockey and baseball enjoy large consumer markets. Throughout the last decade, however, the entirety of sports has suffered from fans's shortened attention spans and busy schedules. This is especially true given that the typical sports enthusiast of the day enjoys and follows such a wide range of different sports. Because most fans do not have the time to attend or watch a wide spectrum of sports and sporting events, most sports enthusiasts greatly depend on sports news and highlight shows to keep them aware of what is happening in the world of sports.

Sports news and highlight shows, by their very nature, feature mainly the exciting sports highlights as a means not so much of communicating scores and other sport-related information but of entertainment value. The entertainment value of these shows is obviously important for achieving a high level of viewership, which is the case for most of the high quality programming. Given this, it is apparent that fans crave highlights because they are often exciting, or at least of great interest as they distill down a large number of sporting events into just a short news show.

To satiate sports enthusiasts' increasing desire for sports entertainment, and to bring sports back from a mere collection of short highlight shows, there is a need for a new and improved sport which utilizes a novel court or flooring structure for facilitating the objects and advantages of the sport.

SUMMARY OF THE INVENTION

The above problems and others are at least partially solved and the above purposes and others realized in a new and improved court for accommodating players in play of a game that employs a ball of a type substantially like that of a conventional basketball. The court is comprised of a spring-loaded floor that includes a playing surface. The playing surface is substantially rectangular and includes ends and goals that are each supported proximate one of the ends. The goals are preferably baskets that are each supported by one of a plurality of padded support The playing surface is provided with markings that define fields, which govern the play of the game. A first springiness or spring bias is provided by the floor at selected ones of the fields, and a second springiness or spring bias is provided by the floor at other selected ones of the fields. The first bias is different from the second bias, and the first and second biases provide players with the ability to jump high into the air during play of a game, and especially around the goals. The floor includes padded fields each positioned near one of the goals for providing soft landing areas for cushioning player falls. In terms of structure, the floor is comprised generally of a spring layer supported by a rigid foundation, and a rugged and deformable resilient layer supported by the spring layer in opposition to the foundation. The resilient layer carries the markings.

BRIEF DESCRIPTION OF THE DRAWINGS

Referring to the drawings.

DESCRIPTION OF THE PREFERRED EMBODIMENT

Figure 1:
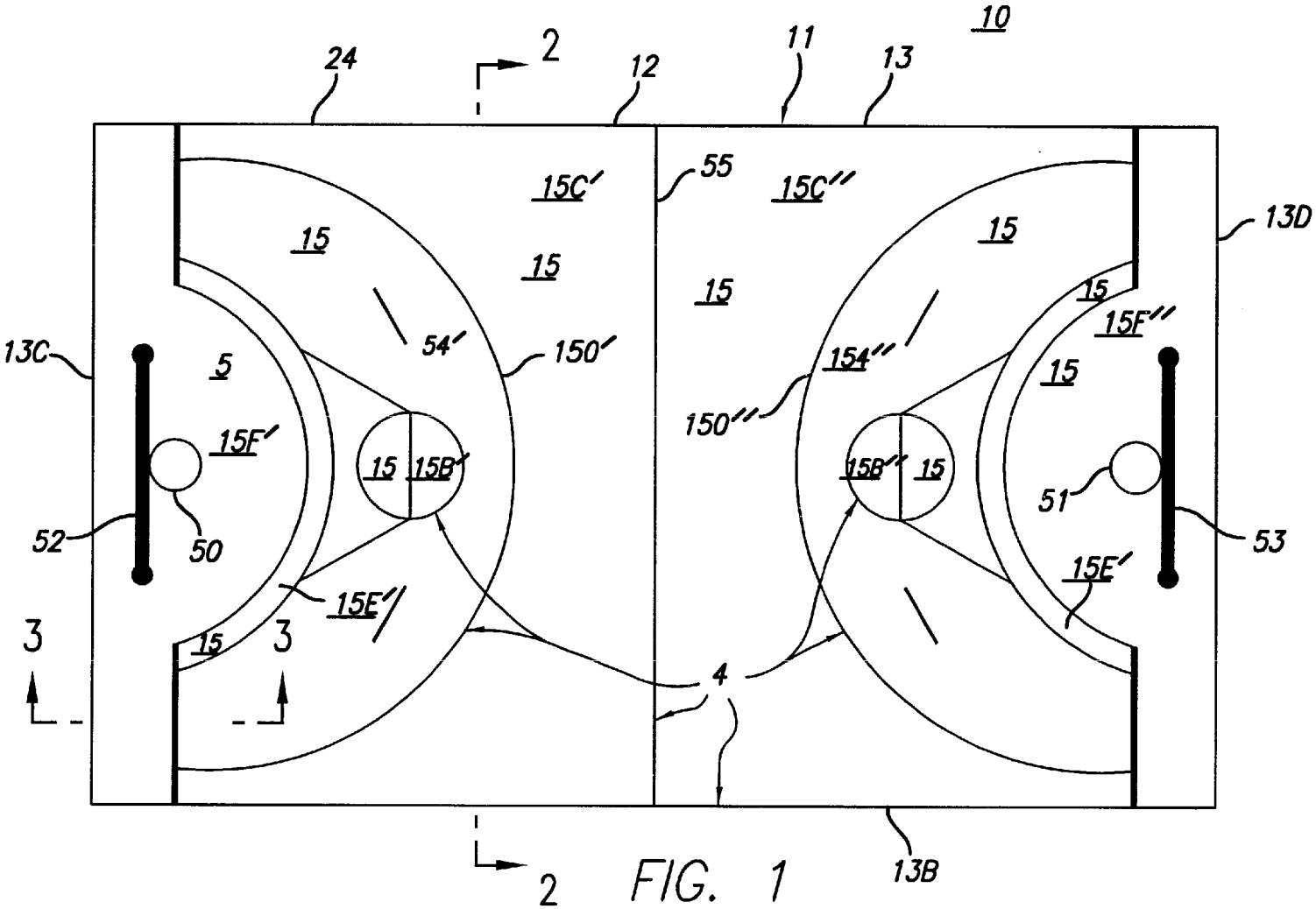
FIG. 1 is a schematic representation of a court constructed and arranged in accordance with the invention, the court for accommodating players in play of a game.

Turning now to the figures, FIG. 1 illustrates a schematic representation of a court 10 for accommodating players in play of a game. Court 10 is comprised of a floor structure 11 that is substantially planar and that defines a substantially flat or planar playing surface 12. Playing surface 12 is substantially rectangular as defined by an outer boundary or perimeter 13. In this regard, perimeter 13 defines opposing sides 13A and 13B that are substantially equal in length, opposing ends 13C and 13D that are substantially equal in width and four right angles. Playing surface 12 is generally the size of a standard basketball court and it may be smaller or larger. Playing surface 12 is provided with markings 14, which define perimeter 13 and divide playing surface 12 into fields 15, which govern the play of the game in accordance with predetermined rules of play.

Figure 2:
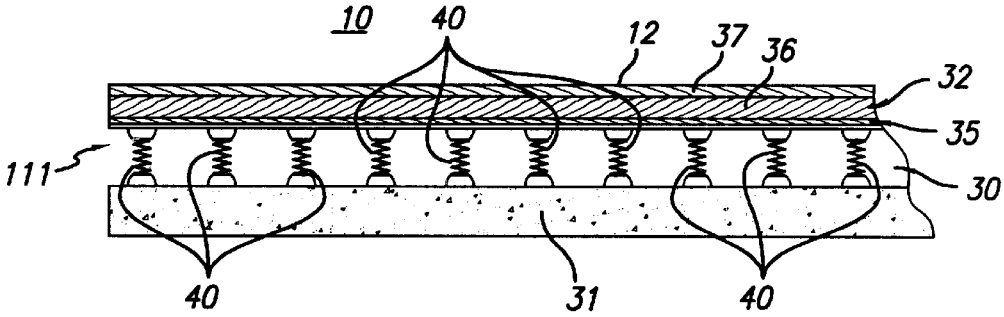
FIG. 2 is a sectional view taken along line 2—2 of FIG. 1.

Turning to FIG. 2, illustrated is a sectional view of floor structure 11 taken along line 2—2 of FIG. 1. Floor structure 11 is comprised of a spring layer 30 supported by a foundation 31 and a rugged and deformable resilient layer 32 supported by spring layer 30 in opposition to foundation 31. Floor structure 11 may comprise a substantially permanently installed structure or a structure that may be moved from place to place. Floor structure 11 may also be formed as an assemblage of a plurality of floor sections as may be desired, which is often the case for sports arenas that regularly change or alter flooring for accommodating different types of games or sporting events. Foundation 31 is rigid and may comprise concrete or other rigid floor or base structure. In this embodiment, layer 32 is comprised of united, superimposed layers including a subfloor 35, a core 36 and a finish layer 37, which defines playing surface 12. The layers may be united with any suitable fastening mechanism or combination of fastening mechanisms such as a suitable adhesive, mechanical construction fasteners such as nails, rivets and/or screws, etc. Subfloor 35 is rugged, flexible and resilient, and is constructed of any material or combination of materials that provide these functional attributes such as thin plywood, plastic, fiberglass, spring steel or other suitable material or combination of materials. As a matter of example, subfloor 35 is formed as two united superimposed layers and it may be constructed with more or less. Core 26 is a shock-absorbing layer that is constructed of any of various light, porous, semirigid or spongy materials, and finish layer 37 is constructed of generally the same material or materials as subfloor 35. Resilient layer 32 may be constructed in a potentially vast variety of forms, suitable for providing rugged flexibility and resiliency. In this spirit, layer 32 may be constructed of a single layer of material or two or more layers of united superimposed layers.

Spring layer 30 provides layer 32 with a springiness or bounciness or spring-loaded bias, much like a spring board. In the embodiment shown in FIG. 2, spring layer 30 is comprised of a plurality or population of springs 40 mounted or fixed in place with screws, adhesive sockets or other suitable engagement mechanism or combination of engagement mechanisms between and to foundation 31 and resilient layer 32 and, more particularly, to subfloor 35. Each spring 40 is comprised of a strong, elastic device that quickly, i.e. substantially immediately, regains its original shape after being compressed. In this spirit, each spring 40 comprises a compression spring, an elastomeric element or other suitable mechanism for providing the spring function as herein described after being compressed under force. In this regard, as players play and run or move about on playing surface 12, the springiness that is provided by floor structure 11 allows them to jump high into the air, such as anywhere from 50 to 60 inches into the air, and this can be less or more depending on the density or springiness of springs 40 and the physical ability of the given player. It is to be understood that resilient layer 32 is flexible and resilient enough that it gives when jumped or pushed against and snaps back to its original shape in response to the spring force provided by spring layer 30. This provides players with the ability to jump at heights that they would not otherwise be able to achieve, such as on a regular or typical basketball court.

Turning back to FIG. 1, court 10 is designed to accommodate players in a game that substantially resembles basketball, and markings 14 generally provide this basketball-type format. In this vein, goals 50 and 51 are each supported proximate ends 13C and 13D, respectively. Goals 50 and 51 oppose one another and are supported at an elevated location by support structures 52 and 53, respectively, much like conventional basketball goals. Goals 50 and 51 are baskets, and they are each suspended at a height of seven to twelve feet above playing surface 12 and other heights may be used. Like basketball, the object of the game is to score points by throwing a ball into and through goals 50 and 51. In this regard, the game is played with a ball that is substantially identical, if not completely identical, to a regulation basketball, and between two teams of, for instance, three or more players each or more or less, the object being to throw or pass the ball through the elevated goal on the opponent's side of court 10. Scoring is substantially similar to normal basketball scoring and it may vary in some respects as may be desired. Because floor structure 11 is springy, players are able to jump to extreme heights, which introduces excitement and a high level of athleticism into the game.

As previously mentioned, markings 14 divide playing surface into fields 15, which govern the play of the game. Because the game is substantially like that of basketball, fields 15 provide this general game governance. To this end, fields 15 comprise opposing keys 15A' and 15A" having free-throw lanes 15B' and 15B" and defensive fields 15E' and 15E", respectively, and general playing fields 15C' and 15C". At the top of each key 15A' and 15A" is a three point line 15D' and 15D", respectively, and a center or division line 55 divides playing surface 12 in half. Defensive fields 15E' and 15E" are located at the bottom of keys 15A' and 15A", respectively, and are reserved for defensive players.

Goals 50 and 51 oppose the bottom of keys 15A' and 15A", respectively. Given that floor structure 11 is springy, it is envisioned that players will attempt to jump at potentially great heights in order to dunk the ball into goals 50 and 51, provide extreme offensive and defensive maneuvers, etc. As a result, ends 13C and 13D of court 10 are provided with padded fields 15F' and 15F", respectively. Field 15F' is substantially equal in width to the width of end 13C, and includes an enlarged portion that extends into the bottom of key 15A' and, more particularly, into abutment or at least substantial abutment with field 15E'. Field 15F" is substantially equal in width to the width of end 13D, and includes an enlarged portion that extends into the bottom of key 15A" and, more particularly, into abutment or at least substantial abutment with field 15E". Padded fields 15F' and 15F" provide cushioning support around goals 50 and 51 for cushioning player falls for preventing or at least inhibiting injury around goals 50 and 51. For additional safety, support structures 52 and 53 are also padded or otherwise provided with padding, foam or a cushionlike mass of soft material substantially about their entire extent for providing the players with cushioning against impacts. The padding of support structures 52 and 53 may be of any suitable form, construction or design for providing this desired cushion.

Figure 3:
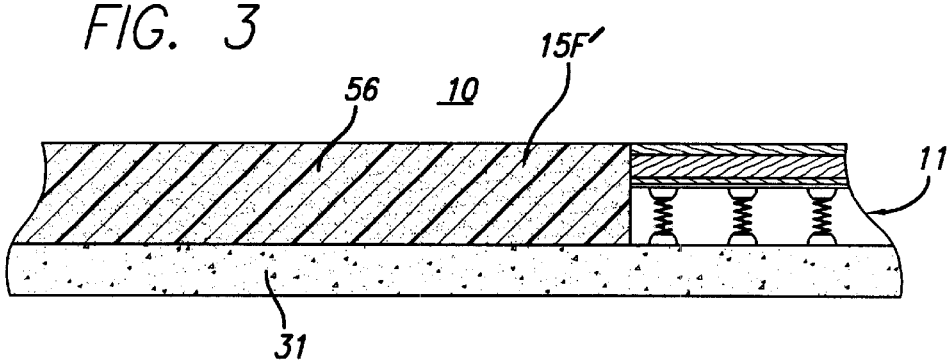
FIG. 3 is a sectional view taken along line 3—3 of FIG. 1.

With momentary attention directed to FIG. 3, shown is a sectional view taken along line 3—3 of FIG. 1. The purpose of FIG. 3 is to illustrate a representational sectional view of floor structure 11 including padded field 15F', and this is substantially identical to padded field 15F", which will not be discussed. In this regard, padded field 15F' is comprised of a padded structure, mat or matting 56 that is constructed of a padding, foam or cushionlike mass of soft material. In this embodiment, matting 56 rests upon foundation 31, abuts against the other portions of floor structure 11 and is substantially flush with playing surface 12. Matting 56 may be designed and positioned on top of playing surface 12 if desired.

The springiness or spring-loaded bias provided by floor structure 11 can be substantially uniform throughout playing surface 12, or may vary between fields 15, which is preferably the case. In a preferred embodiment, the springiness or spring-loaded bias of floor 11 is greatest at keys 15A' and 15A", which provides players with a maximum jumping capability around goals 50 and 51. To vary the springiness or spring-loaded bias, the density of springs 40 may be varied and/or springs 40 may be constructed specifically to provide a greater or lesser amount of spring. In terms of density, the lower the population density of springs 40, the greater the springiness. So, the parts of floor structure 11 provided at fields 15A' and 15A" are preferably provided with a lower population density of springs 40 than the other parts of floor structure 11 and/or are constructed with springs 40 that have a greater degree of springiness than other parts of floor structure 11.

Thus, a new and improved court is disclosed, which includes markings that govern play of a game that employs a ball and a floor structure that allows players to leap or jump to extreme heights, especially around goals at opposing ends of the court. The design and structure of the court takes regular basketball and elevates it to an exciting and extreme level, which is envisioned to attract a wide acceptance among sports enthusiasts. Although playing surface 12 is preferably rectangular, it may be square, round, oval or other desired shape.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A sport floor structure for a ball game, comprising:

a rigid foundation;

a spring layer supported by the rigid foundation; and a playing surface supported by the spring layer, the playing surface suitable for supporting human players and hard enough to permit bouncing of a pressurized game ball in a fashion substantially like that of basketball, the playing surface comprising a rugged and deformable resilient layer, and the rugged and deformable resilient layer divided into a plurality of separate fields according to markings on the playing surface, wherein a density of the spring layer supporting at least one of the separate fields is greater than a density of the spring layer supporting at least another one of the separate fields, whereby the at least one of the separate fields is a less flexible field and the at least another one of the separate fields is a more flexible field in response to a player jumping on the rugged and deformable resilient layer.

2. The sport floor structure of claim 1, further comprising an elevated goal near the springier field.

3. The sport floor structure of claim 2, wherein the markings define a basketball court.

4. The sport floor structure of claim 2, wherein the elevated goal is a basket suspended not less than seven feet and not greater than twelve feet above the playing surface.

5. The sport floor structure of claim 4, further comprising a padded mat near the elevated goal and substantially flush with the playing surface.

6. The sport floor structure of claim 4, further comprising a padded mat near the elevated goal and lying on the playing surface.

7. The sport floor structure of claim 1, wherein the rigid foundation is a concrete floor.

8. The sport floor structure of claim 1, wherein the rugged and deformable resilient layer comprises a plurality of layers.

9. The sport floor structure of claim 8, wherein the plurality of layers comprise a subfloor, a core, and a finish layer.

10. The sport floor structure of claim 1, wherein the spring layer comprises a plurality of springs mounted to the rigid foundation and attached to the rugged and deformable resilient layer.

11. The sport floor structure of claim 10, wherein the plurality of springs are compression springs.

* * * * *